US008263850B2

(12) United States Patent
Hashimoto et al.

(10) Patent No.: US 8,263,850 B2
(45) Date of Patent: Sep. 11, 2012

(54) PERCUSSION DETECTING APPARATUS

(75) Inventors: Ryuji Hashimoto, Hamamatsu (JP); Kenichi Nishida, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 127 days.

(21) Appl. No.: 12/773,654

(22) Filed: May 4, 2010

(65) Prior Publication Data

US 2010/0282047 A1 Nov. 11, 2010

(30) Foreign Application Priority Data

May 8, 2009 (JP) ..... 2009-113500

(51) Int. Cl.
*G10H 3/12* (2006.01)

(52) U.S. Cl. ..... 84/723; 84/730; 84/733; 84/734; 84/743

(58) Field of Classification Search ..... 84/723, 84/730, 733, 734, 743
See application file for complete search history.

(56) References Cited

U.S. PATENT DOCUMENTS

| | | | | |
|---|---|---|---|---|
| 4,947,725 | A * | 8/1990 | Nomura | 84/723 |
| 5,892,169 | A * | 4/1999 | Shapiro | 84/411 M |
| 5,977,473 | A * | 11/1999 | Adinolfi | 84/723 |
| 6,069,307 | A * | 5/2000 | Rogers | 84/411 R |
| 6,121,538 | A * | 9/2000 | Yoshino et al. | 84/738 |
| 6,483,017 | B1 * | 11/2002 | Dill et al. | 84/411 R |
| 6,525,249 | B1 * | 2/2003 | Suenaga | 84/411 R |
| 6,586,666 | B2 * | 7/2003 | Abe | 84/477 R |
| 6,639,140 | B2 * | 10/2003 | Mishima | 84/600 |
| 6,753,467 | B2 * | 6/2004 | Tanaka et al. | 84/723 |
| 6,784,352 | B2 * | 8/2004 | Suenaga | 84/411 R |
| 6,794,569 | B2 * | 9/2004 | Kamijima et al. | 84/746 |
| 6,921,857 | B2 * | 7/2005 | Yoshino et al. | 84/738 |
| 7,135,630 | B2 * | 11/2006 | Maruhashi et al. | 84/411 P |
| 7,196,261 | B2 * | 3/2007 | Suenaga | 84/730 |
| 7,396,991 | B2 * | 7/2008 | Susami | 84/615 |
| 7,446,255 | B2 * | 11/2008 | Yamaya | 84/731 |
| 7,465,869 | B1 * | 12/2008 | Freitas | 84/723 |
| 7,525,032 | B2 * | 4/2009 | Mishima | 84/477 R |
| 7,569,758 | B2 * | 8/2009 | Harada et al. | 84/411 M |
| 7,642,439 | B2 * | 1/2010 | Fujii | 84/411 M |
| 7,667,130 | B2 * | 2/2010 | Mishima | 84/723 |
| 7,781,661 | B2 * | 8/2010 | Rogers et al. | 84/413 |
| 2001/0045156 | A1 * | 11/2001 | Mishima | 84/723 |
| 2003/0037660 | A1 * | 2/2003 | Suenaga | 84/411 R |
| 2003/0188629 | A1 * | 10/2003 | Suenaga | 84/723 |

(Continued)

FOREIGN PATENT DOCUMENTS

| | | |
|---|---|---|
| JP | 6175651 | 6/1994 |

(Continued)

*Primary Examiner* — David S. Warren
(74) *Attorney, Agent, or Firm* — Morrison & Foerster LLP

(57) ABSTRACT

A percussion detecting apparatus capable of enhancing an effect of disturbance interception by intercepting a micro-vibration conveyed from a support frame. A pad member has a pad having a back-side surface to which a base is fixed, and a percussion sensor is disposed on a back-side surface of the base. The pad member is supported by a frame via fixing members integral with the pad member and intervening members made of silicon rubber. Vertical protrusions having different protrusion heights are formed on an upper surface of a flange of each intervening member, and horizontal protrusions are formed on an inner peripheral surface of a through-hole of each intervening member. When the pad member in an unstruck state, each fixing member is in contact with a corresponding one of the intervening members only at the vertical and horizontal protrusions of the intervening member.

8 Claims, 5 Drawing Sheets

U.S. PATENT DOCUMENTS

| | | | | |
|---|---|---|---|---|
| 2003/0209132 | A1* | 11/2003 | Mishima | 84/730 |
| 2004/0025663 | A1* | 2/2004 | Harada et al. | 84/104 |
| 2004/0083873 | A1* | 5/2004 | Yoshino et al. | 84/107 |
| 2004/0118269 | A1* | 6/2004 | Yoshino | 84/723 |
| 2004/0134332 | A1* | 7/2004 | Kamijima et al. | 84/411 R |
| 2004/0149120 | A1* | 8/2004 | Maruhashi et al. | 84/411 R |
| 2004/0211310 | A1* | 10/2004 | Hagiwara et al. | 84/726 |
| 2005/0022655 | A1* | 2/2005 | Wise | 84/743 |
| 2005/0145101 | A1* | 7/2005 | Yoshino | 84/723 |
| 2005/0145102 | A1* | 7/2005 | Susami | 84/735 |
| 2005/0150366 | A1* | 7/2005 | Susami | 84/735 |
| 2005/0223880 | A1* | 10/2005 | Yoshino et al. | 84/738 |
| 2006/0021495 | A1* | 2/2006 | Freitas | 84/723 |
| 2006/0219092 | A1* | 10/2006 | Mishima | 84/724 |
| 2007/0051231 | A1* | 3/2007 | Fujii | 84/723 |
| 2007/0163422 | A1* | 7/2007 | Rogers et al. | 84/411 R |
| 2007/0163423 | A1* | 7/2007 | Rogers | 84/411 R |
| 2007/0245884 | A1* | 10/2007 | Yamaya | 84/731 |
| 2009/0000464 | A1* | 1/2009 | Mishima | 84/724 |
| 2009/0229450 | A1* | 9/2009 | Hashimoto | 84/723 |
| 2009/0249939 | A1* | 10/2009 | Rogers et al. | 84/413 |
| 2010/0064880 | A1* | 3/2010 | Takehisa et al. | 84/609 |
| 2010/0064881 | A1* | 3/2010 | Takehisa | 84/609 |
| 2010/0282047 | A1* | 11/2010 | Hashimoto et al. | 84/723 |
| 2010/0313732 | A1* | 12/2010 | Yoshino et al. | 84/413 |
| 2011/0252943 | A1* | 10/2011 | Zuffante et al. | 84/413 |

FOREIGN PATENT DOCUMENTS

| | | |
|---|---|---|
| JP | 2002-169546 | 6/2002 |

* cited by examiner

PERCUSSION DETECTING APPARATUS

BACKGROUND OF THE INVENTION

1. Field of the Invention

The present invention relates to a percussion detecting apparatus for detecting a vibration of a pad being struck and outputting a detection signal for production of a musical tone.

2. Description of the Related Art

Conventionally, there has been known an electronic drum or other electronic percussion instrument that produces a musical tone based on a detection signal from a percussion detecting apparatus having a sensor for detecting a vibration of a pad being struck at its percussion surface. A percussion detecting apparatus of this type generally has a drum-shaped pad member supported by a support frame.

For example, a musical instrument disclosed in Japanese Laid-open Patent Publication No. 6-175651 has a main body made of hard rubber and formed into a shallow dish shape, a base plate formed by an iron plate and disposed at a bottom of the main body, and a base on which the main body and the base plate are supported. A pad plate embedded in a pad rubber having a percussion surface is supported by the base plate via a doughnut-shaped cushion member, a pad sensor is fixed to a back surface of the pad plate, and a rim sensor is fixed to an inner periphery of a rim plate embedded in a periphery of the main body of the musical instrument.

When a player strikes the pad, the pad plate vibrates and a vibration of the pad plate is detected by the pad sensor. When the player strikes the rim to play a rimshot, the rim plate vibrates and a vibration of the rim plate is detected by the rim sensor.

Since the pad plate is not in direct contact with the rim, but in contact with the rim via the pad rubber made of rubber softer than the rubber constituting the rim, a vibration conveyed from the rim is attenuated by the pad rubber and is not conveyed to the pad sensor. Each of the pad sensor and the rim sensor detects a vibration in the form of electrical signal, which is amplified by an amplifier and sounded as a musical tone by a speaker.

In another musical instrument disclosed in Japanese Laid-open Patent Publication No. 2002-169546, a pad member, a percussion detecting sensor, and a sensor support are supported via a disk-shaped thin-film elastic member by an upper case (case member) so as to float from the upper case.

Specifically, the sensor support mounted with the percussion detecting sensor is coupled, together with the thin-film elastic member, to the pad member via a bridge member. The thin-film elastic member made of synthetic resin having elasticity and hard to convey a vibration is formed into a disk shape having a thickened portion and a thin-film portion disposed radially outwardly of the thickened portion. The thin-film portion is sandwiched and fixed between a stay of a light-emitting unit and the upper case. When the pad member is in an unstruck state, the pad member, the sensor, and the sensor support are coupled via only the thin-film portion of the elastic member to the upper case so as to float from the upper case, i.e., made independent from the upper case in respect of vibration transmission. As a result, a vibration transmitted from the case member is substantially intercepted at the thin film portion, so that transmission of the vibration to the sensor is effectively suppressed, thereby preventing noise from occurring, which would be otherwise caused when another pad or the case member is struck.

In the musical instrument disclosed in Japanese Laid-open Patent Publication No. 6-175651, an external vibration other than a vibration of the pad member (e.g., a vibration of the floor or a vibration caused when another pad or the case member is struck) is sometimes conveyed to the base. In that case, the external vibration is absorbed by the cushion member, if the vibration is a vertical vibration. However, a micro-vibration having a small amplitude is not effectively absorbed by the cushion member and detected by the pad sensor (if the sensor is highly sensitive), which poses a problem that the detected micro-vibration provides a disturbance in the production of a musical tone (so-called noise intrusion).

In addition, since a motion of the pad plate is restricted by the rim and hence a lateral vibration cannot be absorbed, the lateral vibration is detected by the pad sensor and sometimes provides a disturbance.

With the musical instrument disclosed in Japanese Laid-open Patent Publication No. 2002-169546, a vibration transmitted from, e.g., the floor to the upper case constituting a part of the support frame is absorbed, if the vibration is a vertical vibration, by the thin-film portion of the elastic member. On the other hand, since the thin-film portion is formed to laterally extend in a plane, a lateral vibration is hardly absorbed by the thin-film portion and is sometimes detected by the sensor, resulting in occurrence of disturbance.

SUMMARY OF THE INVENTION

The present invention provides a percussion detecting apparatus capable of enhancing an effect of disturbance interception by intercepting a micro-vibration conveyed from a support frame.

According to a first aspect of this invention, there is provided a percussion detecting apparatus, which comprises a percussion sensor configured to detect a vibration of a pad member being struck, the pad member having a percussion surface adapted to be struck, and an intervening member disposed between the pad member and a support frame, the intervening member having a base surface on which a first protrusion having elasticity is protrudingly formed, wherein at least one of the pad member and the support frame is in contact with the intervening member at the first protrusion of the intervening member when the pad member is in an unstruck state.

With this invention, a micro-vibration from the support frame can be intercepted, whereby the effect of disturbance interception can be enhanced.

The intervening member can have, as the base surface, a plurality of base surface portions that face different directions and extend along a direction having a component perpendicular to the percussion surface, a plurality of protrusions, including the first protrusion, are formed on respective ones of the plurality of base surface portions so as to protrude indifferent directions, and a position of the pad member in the unstruck state in a direction parallel to the percussion surface is restricted by the plurality of protrusions.

With this construction, it is possible to suppress the percussion sensor from detecting a micro-vibration in the direction parallel to the percussion surface.

The intervening member can have, as the base surface, a base surface portion extending in a direction having a component parallel to the percussion surface, the first protrusion is protrudingly formed on the base surface portion, and a position of the pad member in the unstruck state in a direction vertically of the percussion surface is restricted by the first protrusion.

With this construction, it is possible to suppress the percussion sensor from detecting a micro-vibration in the direction perpendicular to the percussion surface.

The first protrusion protrudingly formed on the base surface portion can be collapsed by the at least one of the pad member and the support frame and the at least one of the pad member and the support frame can be in contact with the base surface portion when the percussion surface is struck.

With this construction, it is possible to ensure that a striking force is securely received, whereby satisfactory performance is ensured.

The intervening member can have, as the base surface, a plurality of slant face portions that face different directions and each extend along a direction having a component oblique to the percussion surface of the pad member, a plurality of protrusions, including the first protrusion, are respectively formed on the slant face portions so as to protrude in different directions, and positions of the pad member in the unstruck state in directions perpendicular to and parallel to the percussion surface are restricted by the plurality of protrusions.

With this construction, it is possible to suppress the percussion sensor from detecting micro-vibrations in the directions perpendicular to and parallel to the percussion surface.

A plurality of protrusions, including the first protrusion, having different protrusion heights can be formed on the base surface of the intervening member so as to protrude in a same direction, and the at least one of the pad member and the support frame can be in contact with at least one protrusion having a largest protrusion height among the plurality of protrusions when the pad member in the unstruck state, and can be in contact also with other of the plurality of protrusions when the pad member is applied with a displacement force.

With this construction, it is possible to generate a reaction force that varies in plural stages with the increase in a displacement force applied to the pad member, whereby performance can be improved.

The first protrusion can have an area of cross-section perpendicular to a direction in which the first protrusion is protrudingly formed that becomes smaller toward a tip end of the first protrusion.

With this construction, it is possible to generate a reaction force that smoothly increases with the increase in displacement force applied to the pad member, whereby performance can be improved.

A plurality of protrusions, including the first protrusion, can be formed integrally with the intervening member, a protrusion among the plurality of protrusions extending in a direction having a component parallel to the percussion surface and a protrusion among the plurality of protrusions extending in a direction having a component perpendicular to the percussion surface.

With this construction, it is possible to suppress the percussion sensor from detecting micro-vibrations in the directions perpendicular to and parallel to the percussion surface and to simplify the construction of the intervening member.

The support frame can have an annular rib formed with a plate portion projecting inwardly from an inner surface of the annular rib, a fixing member can be fixed to the pad member, the fixing member having a flange and a cylindrical portion that extends from the flange and is inserted through the annular rib, the intervening member can be disposed between the fixing member and the annular rib, the intervening member can be formed with a plurality of protrusions, including the first protrusion, a protrusion among the plurality of protrusions is in contact with or for contact with the flange of the fixing member or with the plate portion of the annular rib, and a protrusion among the plurality of protrusions is in contact with or for contact with the inner surface of the annular rib or with an outer surface of the fixing member.

With this construction, it is possible to suppress the percussion sensor from detecting micro-vibrations in directions perpendicular to and parallel to the percussion surface.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
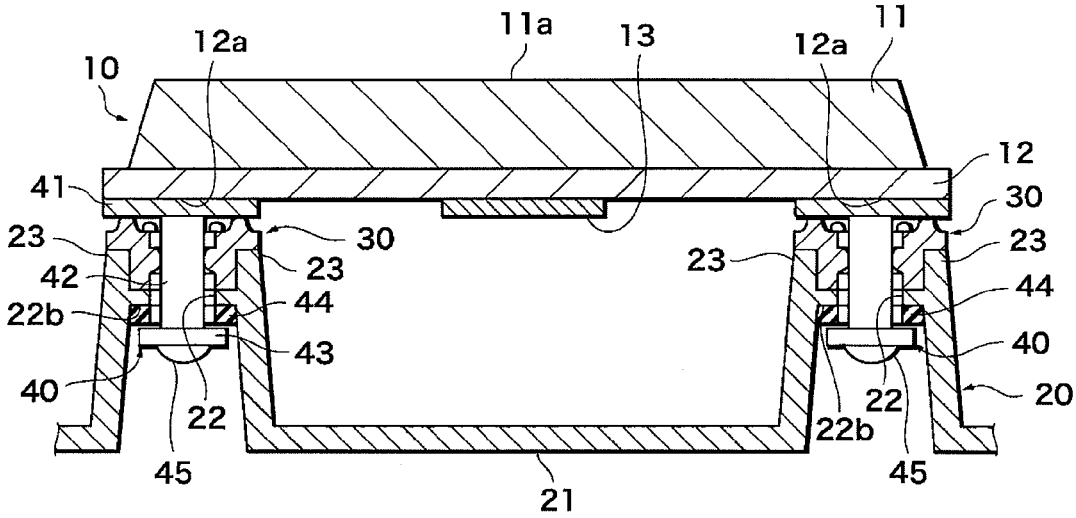
FIG. 1 is a schematic vertical section view showing one frame and one pad member supported on the frame in an electronic percussion instrument to which a percussion detecting apparatus according to one embodiment of this invention is applied.

FIG. 1 schematically shows in vertical cross section a frame, a pad member supported on the frame, and their surroundings in an electronic percussion instrument to which a percussion detecting apparatus according to one embodiment of this invention is applied. The electronic percussion instrument is configured as an electronic drum that electronically generates a musical tone.

The percussion instrument includes frames 20 supported by a drum rack (not shown) and pad members 10 supported by respective ones of the frames 20. In FIG. 1, only one of the frames 20 and only one of the pad members 10 are shown. The pad members 10 are each configured for use in a snare drum or a tom-tom, but are not limited thereto. Although the size and shape of the pad members 10 vary depending on the type of pad members, such variations do not affect the below-described basic construction of the percussion detecting apparatus.

Figure 2:
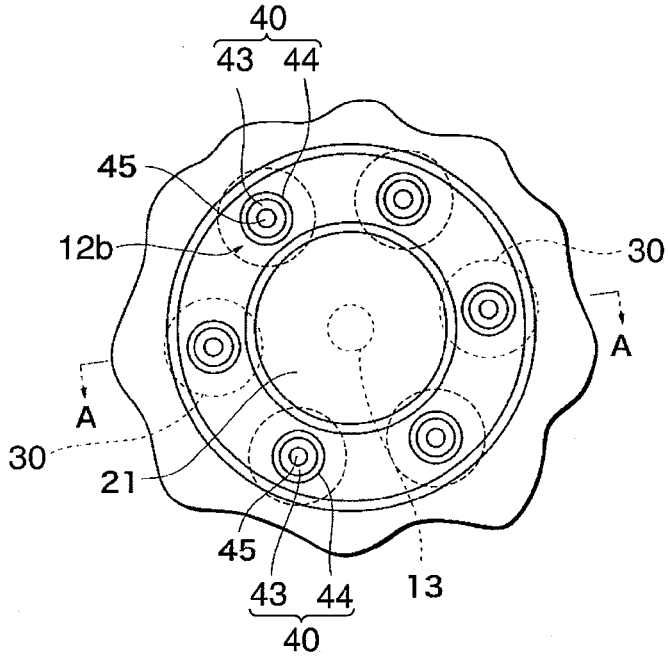
FIG. 2 is a fragmentary bottom view showing apart of one frame, together with fixing members by which the pad member is fixed to the frame.

FIG. 2 shows in fragmentary bottom view a part of one frame 20 and fixing members that fix the corresponding pad member 10 to the frame 20. Line A-A in FIG. 2 is a section line along which FIG. 1 is taken.

The pad member 10 includes a circular pad 11 and a circular base 12 fixed to a back-side surface of the pad 11. An upper surface (front-side surface) of the pad 11 provides a percussion surface 11*a* adapted to be struck. In the following, it is assumed that the pad member 10 is disposed such that the percussion surface 11*a* becomes horizontal although such is not essential.

On a back-side surface of the base 12, a percussion sensor 13 is disposed that has a piezoelectric device or other device for converting a vibration of the base 12 into an electrical signal based on which the sensor 13 detects whether the pad 11 is struck and detects the intensity of the striking. It should be noted that the construction and installed position of the percussion sensor 13 are not limited so long as the sensor 13 is able to detect the striking in terms of vibration. When the percussion surface 11*a* of the pad 11 is struck, the base 12 vibrates and the vibration is detected by the percussion sensor 13. Based on a detection signal supplied from the sensor 13, a musical tone generator (not shown) generates a drum sound. It should be noted that the musical tone generator can be configured separately from the percussion detecting apparatus.

The frame 20 is made of, e.g., resin, and has a circular bottom portion 21 corresponding to one pad member 10. The frame 20 has annular ribs 23 formed at plural places (e.g., six places) around the bottom portion 21 integrally therewith. The annular ribs 23 extend upward from the bottom portion 21 and each have a plate portion 22 formed integrally therewith.

Intervening members 30 and fixing members 40 are provided at six places so as to correspond to respective ones of the six annular ribs 23. The pad member 10 is fixed via the intervening members 30 to the frame 20 by the fixing members 40. Annular rubber washers 44 are each fixedly disposed inside a corresponding annular rib 23 in contact with a lower surface 22*b* of a corresponding plate portion 22.

Figure 3:
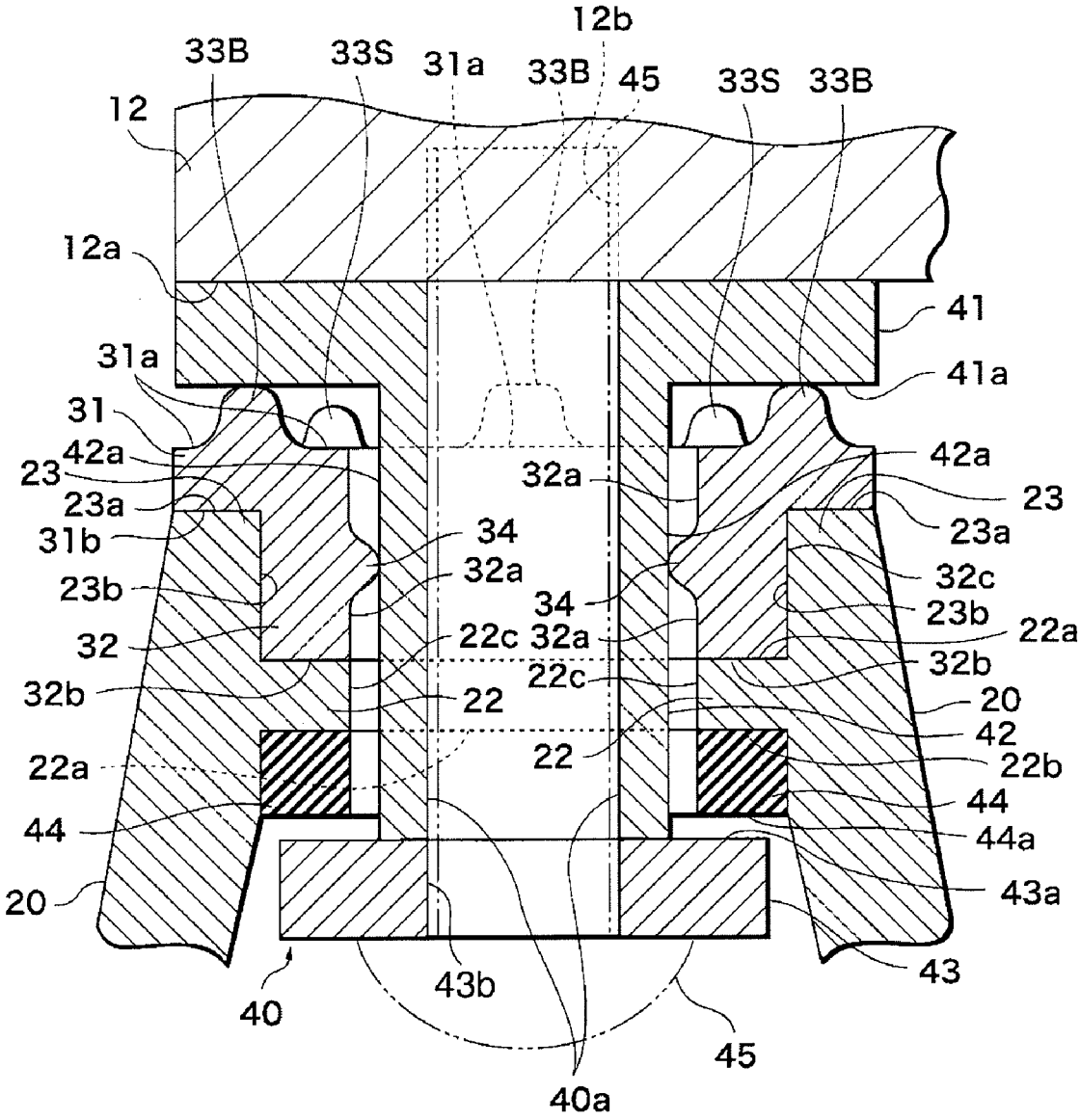
FIG. 3 is a fragmentary enlarged vertical section view showing one fixing member, one intervening member, and their surroundings.
Figure 4:
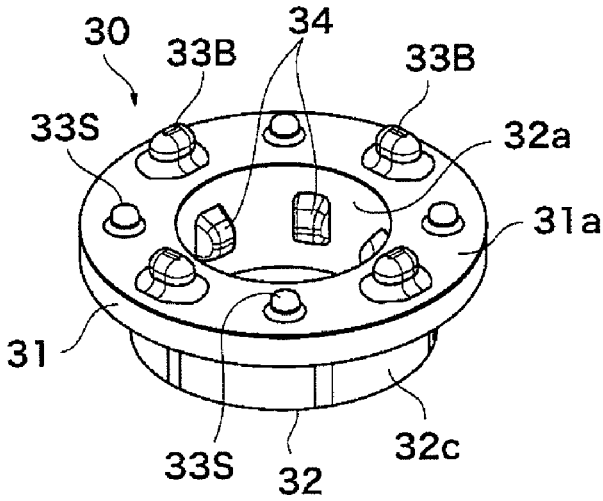
FIG. 4 is a perspective view showing the one intervening member.
Figure 5:
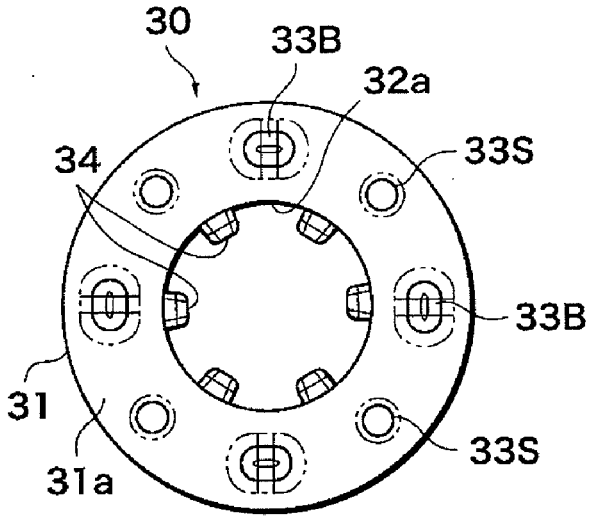
FIG. 5 is a plan view showing the one intervening member.
Figure 6:
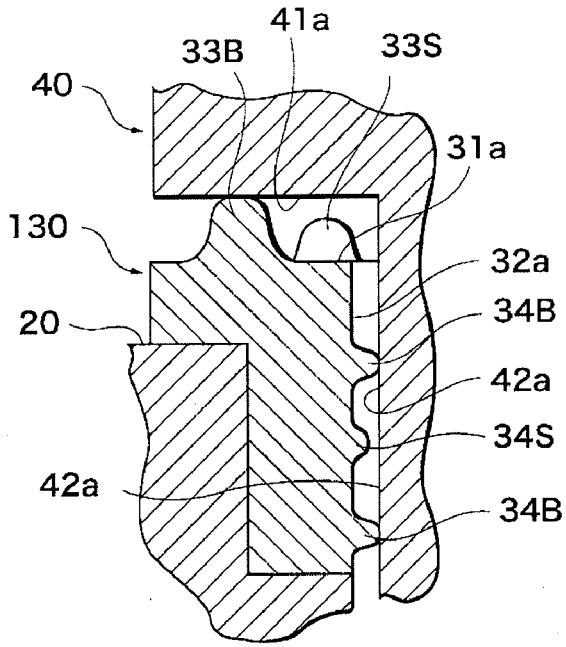
FIG. 6 is a fragmentary enlarged vertical section view showing a left half of an intervening member according to a first modification.

FIG. 3 shows one fixing member 40, the corresponding intervening member 30, and their surroundings in vertical cross section. FIGS. 4 and 5 show the intervening member 30 in perspective view and in plan view.

As shown in FIG. 3, the fixing member 40 has an upper flange 41 and a cylindrical portion 42, which are formed integrally together, and has a lower flange 43 fixed to a lower end surface of the cylindrical portion 42. A mounting hole 40*a* is formed vertically of the fixing member 40 to extend from the upper flange 41 to the cylindrical portion 42. The lower flange 43 is formed into a washer-shape and formed with a through-hole 43*b* that communicates with the mounting hole 40*a*.

The plate portion 22 is formed with a through-hole 22*c* through which the cylindrical portion 42 of the fixing member 40 extends.

In a state that the upper flange 41 is in contact with the back surface 12*a* of the base 12, a screw 45 is inserted into the through-hole 43*b* of the lower flange 43 and the mounting hole 40*a* of the fixing member 40 from below, and threadedly engaged with a screw hole 12*b* of the base 12, whereby the fixing member 40 is integrally fixed to the base 12.

The fixing member 40 can be fixed to the pad member 10 by any method or alternatively can be formed integrally with the base 12. The fixing member 40 is made of a highly rigid material such as metal. The lower flange 43 of the fixing member 40 can be formed integrally with the upper flange 41 and the cylindrical portion 42.

The intervening members 30 each function as an insulator that intercepts or suppresses transmission of a vibration between the frame 20 and the pad member 10. The intervening members 30 can be made of any material having elasticity, such as silicon rubber, butyl rubber, natural rubber, or urethane rubber. In this embodiment, silicon rubber is used, which is advantageous in that it has a less dependency on temperature and less permanent deformation. The intervening members 30 are formed by, e.g., die injection molding.

As shown in FIGS. 3 to 5, each of the intervening members 30 has a flange 31 and a cylindrical portion 32, which are integrally formed together. Vertical protrusions 33B, 33S (hereinafter, sometimes collectively denoted by reference numeral 33) are protrudingly integrally formed on an upper surface 31*a* of the flange 31.

The vertical protrusions 33B are larger in protrusion height than the vertical protrusions 33S. The vertical protrusions 33B and the vertical projections 33S, each four in number, are alternately disposed circumferentially of the flange 31 at equal intervals.

The intervening member 30 is formed with a through-hole 32*a* extending vertically therethrough and having a diameter larger than an outer diameter of the cylindrical portion 42 of the fixing member 40. Horizontal protrusions 34 are protrudingly integrally formed on an inner peripheral surface of the through-hole 32*a*. As shown in FIG. 5, the horizontal protrusions 34, which are six in total number, are arranged circumferentially of the flange 31 at equal intervals.

The vertical protrusions 33B, 33S and the horizontal protrusions 34 of the intervening member 30 each have a tip end portion which is formed to have a convex curved surface whose cross section decreases toward a tip end of the corresponding protrusion. The upper surface 31*a* of the flange 31 is formed into a horizontal flat surface as a base surface, and the vertical protrusions 33B, 33S straightly protrude upward in a direction perpendicular to the base surface. The horizontal protrusions 34 horizontally protrude toward the center line of the through-hole 32*a*. If the inner peripheral surface of the through-hole 32*a* is taken as a base surface, it can be said that the horizontal protrusions 34 protrude perpendicular to the base surface.

A circle extending circumferentially of the flange 31 and passing through the tip ends of the horizontal protrusions 34 has a diameter slightly smaller than the outer diameter of the cylindrical portion 42 of the intervening member 30 in a natural state. Thus, the horizontal protrusions 34 of the intervening member 30 mounted to the fixing member 40 are in press-contact at their tip ends with an outer peripheral surface 42*a* of the cylindrical portion 42 such that the tip ends of the horizontal protrusions 34 are made slightly elastically deformed, whereby the horizontal position of the pad member 10 in an unstruck state is restricted.

As shown in FIG. 3, the intervening member 30 is interposed between the frame 20 and the pad member 10. In that state, the lower surface 31*b* of the flange 31 of the intervening member 30 is contact with the upper end surface 23*a* of the annular rib 23 of the frame 20, the lower end surface 32*b* of the cylindrical portion 32 is in contact with the upper surface 22*a* of the plate portion 22, and an outer peripheral surface 32*c* of the cylindrical portion 32 is in contact with an inner peripheral surface 23*b* of the annular rib 23.

In an initial state where the pad member 10 is in an unstruck state, the vertical protrusions 33B are applied with a load corresponding to the weight of the pad member 10. As a result, the lower surface 41*a* of the upper flange 41 of the fixing member 40 is made in contact with tip ends of the vertical protrusions 33B, and the tip ends of the protrusions 33B are made slightly elastically deformed. On the other hand, the vertical protrusions 33S are not elastically deformed since the height thereof is set such that in the unstruck state, the lower surface 41*a* of the upper flange 41 is not in contact with the vertical protrusions 33S. By the vertical protrusions 33B, the vertical position of the pad member 10 in the unstruck state is restricted.

In FIG. 3, the vertical protrusions 33B and the horizontal protrusions 34 are not illustrated as being elastically deformed, but their tip ends are actually collapsed. As described above, the frame 20 supports the pad member 10 and the fixing member 40 only via the intervening member 30. In particular, the intervening member 30 is or can be in contact only at the vertical protrusions 33B, 33S and the horizontal protrusions 34 with the fixing member 40.

The rubber washer 44 has an inner diameter nearly equal to the inner diameter of the through-hole 22*c* of the plate portion 22 and larger than the outer diameter of the cylindrical portion 42 of the intervening member 30. In an unstruck state, a gap is produced between the lower surface 44*a* of the rubber washer 44 and the upper surface 43*a* of the lower flange 43 of the fixing member 40, and therefore, the fixing member 40 is not engaged with the rubber washer 44 at all. On the other hand, if the vertical protrusions 33 are pressed when the pad member 10 is struck in musical performance, the pad member 10 and the fixing member 40 can temporarily be moved upward by counteraction. In that case, the upper surface 43*a* of the lower flange 43 of the fixing member 40 is brought in contact with the lower surface 44*a* of the rubber washer 44, whereby an excessive upward displacement of the pad member 10 and the fixing member 40 is restricted and a vertical motion thereof is rapidly attenuated.

To fix each pad member 10 to the corresponding frame 20 upon assemblage of the electronic percussion instrument, the base 12 is fixed to the pad 11 to thereby obtain the pad member 10, and the following assembly work is performed at each of six places on the frame 20.

In the assembly work, the rubber washer 44 is fixed by, e.g., adhesive to the lower surface 22*b* of the plate portion 22 of the annular rib 23. It should be noted that it is not inevitably necessary to fix the rubber washer 44 to the plate portion 22. Instead, the rubber washer 44 can be movably interposed between the plate portion 22 and the lower flange 43. Then, the intervening member 30 is fitted onto the cylindrical portion 42 of the fixing member 40, and the cylindrical portion 42 is inserted from above into the annular rib 23 and the through-hole 22*c* of the plate portion 22 of the annular rib 23. Next, the annular rib 23 is aligned with the corresponding screw hole 12*b* of the base 12, and the lower flange 43 is made contact with the cylindrical portion 42 from below. Subsequently, by using a screw 45, the upper flange 41, the cylindrical portion 42, and the lower flange 43 are fastened together and fixed to the base 12.

With the above construction, in an unstruck state, each of the fixing members 40 integral with the pad member 10 is in contact at only the vertical protrusions 33B and the horizontal protrusions 34 with the corresponding intervening member 30, as previously described. More specifically, the pad member 10 is vertically supported at four points per one intervening member 30 and horizontally supported at six points per one intervening member 30, whereby the vertical and horizontal positions of the pad member 10 in an unstruck state are restricted.

Even if the pad member 10 is in an unstruck state, a vibration of the floor or a vibration generated when another pad member is struck is sometimes conveyed to the frame 20. However, the vertical protrusions 33B and the horizontal protrusions 34 having elasticity effectively intercept a small-amplitude vibration (small-displacement vibration), i.e., a micro-vibration, whereby the percussion sensor 13 mounted on the pad member 10 can be prevented from detecting the micro-vibration.

As for a horizontal vibration, since the intervening member 30 has the six horizontal protrusions 34 extending in different directions, the effect of vibration prevention can be exhibited uniformly in any direction. The horizontal protrusions 34 exhibit a great effect since most micro-vibrations as external disturbance are conveyed in a horizontal direction.

When the pad member 10 is struck with a striking force providing a medium load that can frequently occur in musical performance, the upper flange 41 is brought in contact not only with the vertical protrusions 33B but also with the vertical protrusions 33S. When a striking force provides a large load that can occur in musical performance, not only the vertical protrusions 33B but also the vertical protrusions 33S are elastically deformed and collapsed, so that the upper flange 41 is brought in face contact with the upper surface 31*a* of the flange 31 of the intervening member 30. As a result, a striking force, even if it provides a large vertical load, is securely received. In particular, excellent performance is offered by a stepwise increase of a reaction force provided by the vertical protrusions 33B, 33S.

Depending on the way of the pad member 10 being struck and the direction in which a vibration is externally conveyed, a large load is sometimes applied in the horizontal direction. In such a case, one or more of the horizontal protrusions 34 of the intervening member 30, corresponding to the direction of the load, are elastically deformed and collapsed, so that the outer peripheral surface 42*a* of the cylindrical portion 42 of the fixing member 40 is made in contact with the inner peripheral surface of the through-hole 32*a* of the intervening member 30. Accordingly, a large horizontal load or a large displacement motion is securely received.

When the pad member 10 is heavily struck, immediately after the upper flange 41 is made in contact with the flange 31 of the intervening member 30, the pad member 10 attempts to move upward. However, since the lower flange 43 is brought in contact with the rubber washer 44, the upper limit position of the pad member 10 is restricted, and the pad member 10 is rapidly restored to its initial state with ease.

With this embodiment, the intervening member 30 is interposed between the pad member 10 and the frame 20 such that the pad member 10 in an unstruck state is in contact at only the vertical protrusions 33B and the horizontal protrusions 34 with the intervening member 30. It is therefore possible to intercept both micro-vibrations conveyed from the frame 20 in directions perpendicular to and parallel to the percussion surface 11*a*. As a result, a micro-vibration that provides a disturbance can be suppressed from being detected, whereby the disturbance interception effect can be enhanced and accurate detection can be realized, thus preventing an undesired musical tone from being produced (i.e., preventing noise intrusion).

In addition, when a large load is applied, the vertical protrusions 33 and the horizontal protrusions 34 are collapsed, and the fixing member 40 is brought in contact with the base surfaces (i.e., with the upper surface 31*a* of the intervening member 30 and with the inner peripheral surface of the through-hole 32*a*). Thus, a large striking force or an unexpected load is securely received by the frame 20, whereby satisfactory performance can be ensured.

Since the intervening member 30 is formed at its upper surface 31*a* with the vertical protrusions 33B, 33S which are different in protrusion height from each other, a reaction force generation characteristic varies according to the magnitude of applied displacement, whereby a reaction force that varies stepwise in plural stages with the increase in displacement force applied to the pad member 10 can be produced, and therefore, performance can be improved. In addition, since the intervening member 30 including all the vertical protrusions 33 and the horizontal protrusions 34 is integrally formed, the construction of the intervening member 30 can be simplified.

It should be noted that the number of the intervening members 30 per one pad member 10 can be any number, and the intervening members 30 can be disposed at any positions. Also, the number of the vertical protrusions 33 and the horizontal protrusions 34 per one intervening member 30 can be any number and these protrusions can be disposed at any positions. It should be noted that in order to properly achieve the vertical vibration prevention, it is preferable that the intervening members 30 be disposed at not less than three places which are spaced apart in the circumferential direction of the pad member 10. To properly achieve the vibration prevention in any horizontal direction, it is preferable that all the intervening members be configured such that each intervening member includes at least three horizontal protrusions 34 facing different horizontal directions.

Insofar as the point that the protrusions 33, 34 properly function as insulators is concerned, it is enough that each protrusion is formed such that the cross-sectional area of the tip end portion becomes smaller toward the tip end thereof. It should be noted that even if each protrusion is formed into a shape to have nearly the same area from its base portion to its tip end, the effect of the insulator can be achieved to some extent. The insulator function can sufficiently be achieved, if the protrusions 33, 34 are configured such that with the increase in the striking force, the degree of compression of the protrusions 33, 34 increases and the contact areas of the protrusions become larger due to elastic deformation.

It is not inevitably necessary to form the protrusions 33, 34 of the intervening member 30 integrally with the flange 31 and the cylindrical portion 32 of the intervening member 30. Instead, these protrusions can be fabricated separately from the flange and the cylindrical portion and then fixed thereto. It is therefore enough that among the entire intervening member 30 at least the protrusions 33, 34 have elasticity.

Insofar as the prevention of horizontal vibration is concerned, instead of providing the horizontal protrusions 34, the outer diameter of the cylindrical portion 42 can be made nearly equal to the inner diameter of the through-hole 32*a* of the intervening member 30, so that the cylindrical portion 42 is in contact at the outer peripheral surface 42*a* with the inner peripheral surface of the through-hole 32*a* of the intervening member 30.

As for the construction of the intervening members 30, various modifications can be envisaged. FIGS. 6 to 9 each show in vertical cross section one intervening member, which is in an unstruck state, according to each of first to fourth modifications. In each of FIGS. 6 to 8, there is shown only a left half of the intervening member with respect to the vertical center line.

In the embodiment shown in FIGS. 1 to 5, there are two types of vertical protrusions 33 in terms of protrusion height. This is applicable to horizontal protrusions 34. Specifically, in the first modification shown in FIG. 6, horizontal protrusions 34B, 34S which are different in protrusion height are protrudingly formed on the inner peripheral surface of the through-hole 32*a* of the intervening member 130. In an unstruck state where no external force is applied, the outer peripheral surface 42*a* of the cylindrical portion 42 is in contact with only the horizontal protrusions 34B of the intervening member 130. When an external force providing a medium or heavier load is horizontally applied as a displacement force to the pad member 10, the outer peripheral surface 42*a* of the cylindrical portion 42 is brought in contact with not only the horizontal protrusions 34B but also the horizontal protrusions 34S of the intervening member 130.

It should be noted that the number of stages of protrusion height of protrusions are not limited to two. As for both the vertical protrusions 33 and the horizontal protrusions 34, the number of stages of protrusion height can be three or more.

In the embodiment, the intervening member 30 is configured for contact at the protrusions 33, 34 with the fixing member 40 (more generally, with the pad member 10 which is integral with the fixing member 40). However, the intervening member 30 can be disposed between the pad member 10 and the frame 20 for contact with at least one of the pad member 10 (or the fixing member 40) and the frame 20 at only the protrusions 33, 34.

Figure 7:
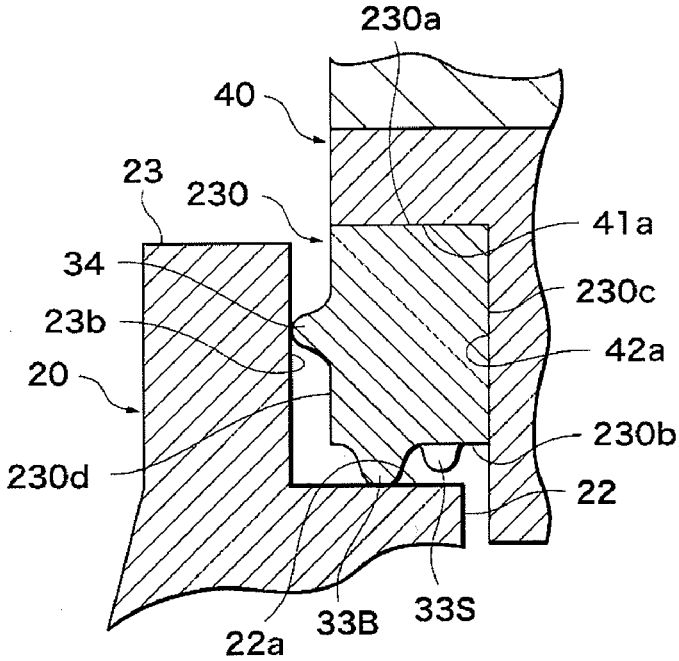
FIG. 7 is a fragmentary enlarged vertical section view showing a left half of an intervening member according to a second modification.
Figure 8:
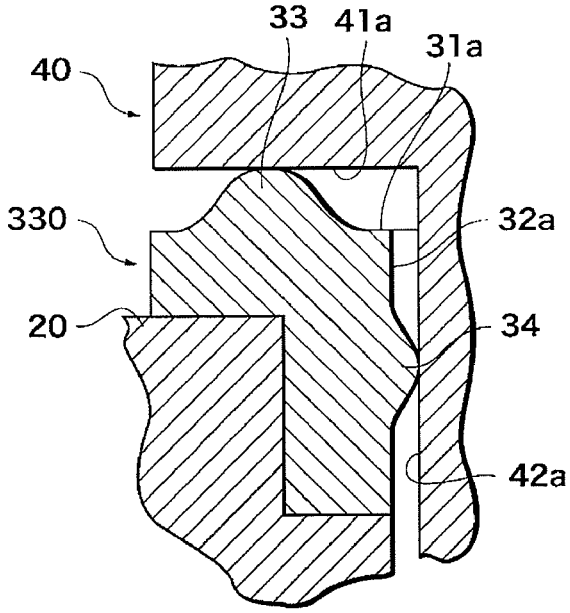
FIG. 8 is a fragmentary enlarged vertical section view showing a left half of an intervening member according to a third modification.

For example, an intervening member 230 of the second modification shown in FIG. 7 has vertical protrusions 33 that are not upwardly protrudingly provided on an upper surface of the intervening member 230, but downwardly protrudingly provided on a lower surface 230*b* of the intervening member 230. The vertical protrusions 33 of the intervening member 230 are in contact with or for contact with the upper surface 22*a* of the plate portion 22, and an upper surface 230*a* of the intervening member 230 is in contact with the lower surface 41*a* of the upper flange 41 of the fixing member 40.

The intervening member 230 has horizontal protrusions 34 (one of which is shown in FIG. 7) that are not provided on an inner peripheral surface 230*c* of the through-hole of the intervening member 230, but provided on an outer peripheral surface 230*d* of the intervening member 230 along the circumferential direction. The horizontal protrusions 34 of the intervening member 230 are in contact with the inner peripheral surface 23*b* of the annular rib 23, and the inner peripheral surface 230*c* of the fixing member 40 is in contact with the outer peripheral surface 42*a* of the cylindrical portion 42 of the fixing member 40.

With the above construction, the vibration prevention effect similar to that attained by the embodiment can be achieved. It should be noted that upper and lower vertical protrusions can be provided on upper and lower surfaces of the intervening member 230 in contact with or for contact with respective ones of the pad member 10 and the frame 20. Similarly, inner and outer horizontal protrusions can be provided on the inner and outer peripheral surfaces 230*c*, 230*d* of the intervening member 230 in contact with or for contact with respective ones of the pad member 10 and the frame 20.

Instead of providing plural types of vertical protrusions 33 having different protrusion heights, one type of vertical protrusions 33 that steplessly increase a reaction force can be provided. For example, an intervening member 330 of a third modification shown in FIG. 8 has vertical protrusions 33 (only one of which is shown) each formed into a board shape having an area of cross-section perpendicular to the protruding direction that becomes smaller toward a tip end of the protrusion 33. This also applies to horizontal protrusions 34 (only one of which is shown). As a result, the protrusions 33, 34 each generate a reaction force that smoothly increases with increase in displacement force applied to the pad member 10, whereby the musical performance can be improved. It should be noted that the protrusions 33, 34 may each be formed into any cross-sectional shape so long as the cross-sectional area becomes smaller toward the tip end.

In the embodiment shown in FIGS. 1 to 5, there are provided the vertical and horizontal protrusions 33, 34 to which the functions of suppressing vertical and horizontal vibrations are separately assigned. However, protrusions for vibration prevention are not limited to the vertical and horizontal protrusions.

Figure 9:
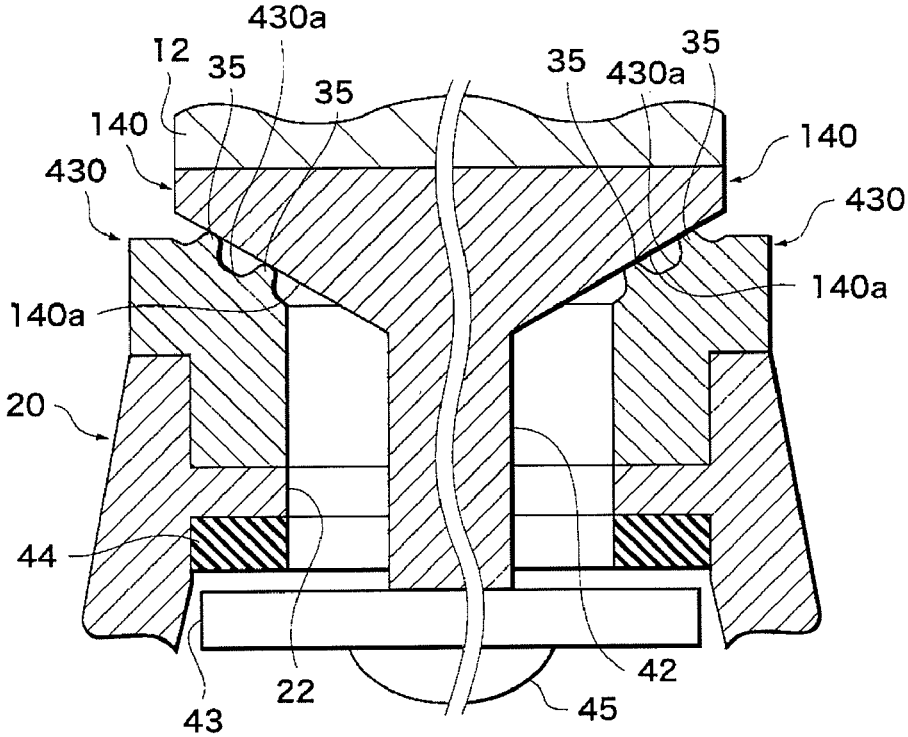
FIG. 9 is a fragmentary enlarged vertical section view of an intervening member according to a fourth modification.

For example, an intervening member 430 of the fourth modification shown in FIG. 9 has a flange (corresponding to the flange 31 of the embodiment) whose upper inner peripheral surface (slant face) 403*a* is formed to have a diameter that becomes smaller toward downward. On the slant face 430*a* (base surface), protrusions 35 are formed to protrude in a direction perpendicular to the base surface. The protrusions 35 are provided at plural places (e.g., eight places) along the circumferential direction of the slant face 430*a*, and protrude in different directions according to angles of inclination of the base surface at places where the respective protrusions 35 are provided.

A fixing member 140 (corresponding to one fixing member 40 of the embodiment) having an upper flange thereof formed into an inverted truncated conical shape is disposed in contact with the intervening member 430. The upper flange of the fixing member 140 has a lower outer surface formed into a slant face 140*a* complementary to and facing the slant face 430*a* of the intervening member 430. In an unstruck state, the slant face 140*a* of the fixing member 140 is in contact with tip ends of the protrusions 35 due to the weight of the pad member 10.

With the above construction, when the pad member 10 is struck and applied with a downward load, the slant face 140*a* of the fixing member 140 downwardly presses the protrusions 35. If the pressing force is large, the protrusion 35 are collapsed downwardly, and the slant face 140*a* of the fixing member 140 is brought in contact with the slant face 430*a* of the intervening member 430. If the pad member 10 is applied with a horizontal load, the slant face 140*a* of the fixing member 140 horizontally presses the protrusions 35. If the pressing force is large, the protrusions 35 are collapsed horizontally, and the slant face 140*a* of the fixing member 140 is brought in contact with the slant face 430*a* of the intervening member 430.

As described above, in the fourth modification, the slant face 430*a* of the intervening member 430 achieves the functions of the upper surface 31*a* and the inner peripheral surface of the through-hole 32*a* of the intervening member 30 in the embodiment, and the protrusions 35 achieve the functions of the vertical and horizontal protrusions 33, 34 in the embodiment. As a result, the effect of suppressing micro-vibrations in both the directions perpendicular to and parallel to the percussion surface 11*a* can be attained. It should be noted that two or more types of protrusions 35 having different protrusion heights can be provided in the fourth modification.

In the fourth modification, the slant face 430*a* (base surface) is provided on the inner periphery of the flange of the intervening member 430 so as to face the outer surface of the upper flange of the fixing member 140. However, a slant face (base surface) can be provided on the outer periphery of the flange of the intervening member 430, and protrusions can be formed on the base surface to protrude perpendicularly to the base surface. In that case, a slant face complementary to and facing the base surface is provided on the frame 20, and tip ends of the protrusions of the intervening member 430 are made in contact with the slant face of the frame 20.

As apparent from the description of the first to fourth modifications, to intercept vertical and horizontal micro-vibrations while securely receiving a large load (large displacement vibration) caused by the striking to thereby ensure satisfactory performance, it is enough to configure the percussion detecting apparatus as described below.

As for the interception of vertical vibration, a base surface portion extending in a direction having a component parallel to the percussion surface 11*a* is provided as a base surface on the intervening member. In addition, one or more protrusions are formed on the base surface portion so as to protrude in a direction having a component perpendicular to the percussion surface 11*a*. When the pad member 10 is in an unstruck state, the position of the pad member 10 in a direction vertically of the percussion surface 11*a* is restricted by the protrusions.

As for the interception of a horizontal vibration, a plurality of vertical base surface portions that extend along a direction having a component perpendicular to the percussion surface 11*a* and that face different directions are provided on at least one intervening member corresponding to one pad member 10. In addition, a plurality of protrusions are formed on these base surface portions so as to protrude in different directions each having a component parallel to the percussion surface 11*a*. When the pad member 10 is in an unstruck state, the position of the pad member 10 in a direction parallel to the percussion surface 11*a* is restricted by the protrusions.

The base surface portion where the protrusion for intercepting a horizontal vibration is formed and the base surface portion where the protrusion for intercepting a vertical vibration is formed can be constituted by the same (common) base surface portion. Specifically, slant face portions that extend along a direction having a component oblique to the percussion surface of the pad member and that face different directions can be formed on the intervening member, and protrusions can respectively be formed on the slant face portions so as to protrude in different directions. In that case, each protrusion formed in each base surface portion (slant face portion) achieves both the function of a protrusion protruding in a direction having a component perpendicular to the percussion surface 11*a* and the function of a protrusion protruding in a direction having a component parallel to the percussion surface 11*a*. It should be noted that it is not inevitably necessary to form each protrusion to protrude in a direction perpendicular to the corresponding base surface. Each base surface is not limited to a flat surface.

In the above-described embodiment and the modifications, it is not inevitably necessary to configure that the protrusions 33 to 35 are in direct contact with the pad member 10 or the frame 20. Each of these protrusions can be configured to be in indirect contact therewith via an intervening element. In that case, it is not inevitably necessary that the intervening element is fixed to the pad member 10 or the frame 20.

What is claimed is:

1. A percussion detecting apparatus, comprising:

a percussion sensor configured to detect a vibration of a pad member being struck, the pad member having a percussion surface adapted to be struck; and an intervening member disposed between the pad member and a support frame, the intervening member having a base surface on which a first protrusion having elasticity is protrudingly formed, wherein at least one of the pad member and the support frame is in contact with said intervening member at the first protrusion of said intervening member when the pad member is in an unstruck state, wherein said intervening member has, as the base surface, a plurality of base surface portions that face different directions and extend along a direction having a component perpendicular to the percussion surface, a plurality of protrusions, including the first protrusion, are formed on respective ones of the plurality of base surface portions so as to protrude in different directions, and a position of the pad member in the unstruck state in a direction parallel to the percussion surface is restricted by the plurality of protrusions.

2. The percussion detecting apparatus according to claim 1, wherein said intervening member has, as the base surface, a base surface portion extending in a direction having a component parallel to the percussion surface, the first protrusion is protrudingly formed on the base surface portion, and a position of the pad member in the unstruck state in a direction vertically of the percussion surface is restricted by the first protrusion.

3. The percussion detecting apparatus according to claim 2, wherein the first protrusion protrudingly formed on the base surface portion is collapsed by the at least one of the pad member and the support frame and the at least one of the pad member and the support frame can be in contact also with the base surface portion when the percussion surface is struck.

4. The percussion detecting apparatus according to claim 1, wherein said intervening member has, as the base surface, a plurality of slant face portions that face different directions and each extend along a direction having a component oblique to the percussion surface of the pad member, a plurality of protrusions, including the first protrusion, are respectively formed on the slant face portions so as to protrude in different directions, and positions of the pad member in the unstruck state in directions perpendicular to and parallel to the percussion surface are restricted by the plurality of protrusions.

5. The percussion detecting apparatus according to claim 1, wherein a plurality of protrusions, including the first protrusion, having different protrusion heights are formed on the base surface of said intervening member, and the at least one of the pad member and the support frame is in contact with at least one protrusion having a largest protrusion height among the plurality of protrusions when the pad member in the unstruck state, and can be in contact with other of the plurality of protrusions when the pad member is applied with a displacement force.

6. The percussion detecting apparatus according to claim 1, wherein the first protrusion has an area of cross-section perpendicular to a direction in which the first protrusion is protrudingly formed that becomes smaller toward a tip end of the first protrusion.

7. The percussion detecting apparatus according to claim 1, wherein a plurality of protrusions, including the first protrusion, are formed integrally with said intervening member, a protrusion among the plurality of protrusions extending in a direction having a component parallel to the percussion surface and a protrusion among the plurality of protrusions extending in a direction having a component perpendicular to the percussion surface.

8. The percussion detecting apparatus according to claim 1, wherein said support frame has an annular rib formed with a plate portion projecting inwardly from an inner surface of the annular rib, a fixing member is fixed to the pad member, the fixing member having a flange and a cylindrical portion that extends from the flange and is inserted through the annular rib, said intervening member is disposed between said fixing member and said annular rib, said intervening member is formed with a plurality of protrusions; including the first protrusion, a protrusion among the plurality of protrusions is in contact with or for contact with the flange of the fixing member or with the plate portion of the annular rib, and a protrusion among the plurality of protrusions is in contact with or for contact with the inner surface of the annular rib or with an outer surface of the fixing member.

* * * * *